US008152937B2

(12) United States Patent
Ishii et al.

(10) Patent No.: US 8,152,937 B2
(45) Date of Patent: Apr. 10, 2012

(54) FERRITIC STAINLESS STEEL SHEET HAVING SUPERIOR SULFURIC ACID CORROSION RESISTANCE AND METHOD FOR MANUFACTURING THE SAME

(75) Inventors: Tomohiro Ishii, Chiba (JP); Yoshimasa Funakawa, Chiba (JP); Takumi Ujiro, Chiba (JP); Masayuki Ohta, Chiba (JP)

(73) Assignee: JFE Steel Corporation (JP)

( * ) Notice: Subject to any disclaimer, the term of this patent is extended or adjusted under 35 U.S.C. 154(b) by 58 days.

(21) Appl. No.: 12/664,913

(22) PCT Filed: Jun. 18, 2008

(86) PCT No.: PCT/JP2008/061501

§ 371 (c)(1),
(2), (4) Date: Feb. 16, 2010

(87) PCT Pub. No.: WO2008/156195

PCT Pub. Date: Dec. 24, 2008

(65) Prior Publication Data

US 2010/0139818 A1 Jun. 10, 2010

(30) Foreign Application Priority Data

Jun. 21, 2007 (JP) ..... 2007-163418
Jul. 6, 2007 (JP) ..... 2007-178097

(51) Int. Cl.
*C22C 38/20* (2006.01)
*C21D 8/02* (2006.01)

(52) U.S. Cl. ..... 148/325; 420/60; 148/602

(58) Field of Classification Search ..... 148/605, 148/325, 602; 420/34, 60
See application file for complete search history.

(56) References Cited

U.S. PATENT DOCUMENTS

| | | | | |
|---|---|---|---|---|
| 5,653,825 | A | 8/1997 | Kohno et al. | |
| 6,391,253 | B1 * | 5/2002 | Tochihara et al. | 420/35 |
| 7,094,295 | B2 | 8/2006 | Oku et al. | |
| 2002/0117239 | A1 | 8/2002 | Oku et al. | |
| 2004/0084116 | A1 * | 5/2004 | Oku et al. | 148/607 |

FOREIGN PATENT DOCUMENTS

| | | | |
|---|---|---|---|
| JP | 56-146857 | A | 11/1981 |
| JP | 06-228710 | A | 8/1994 |
| JP | 07-188866 | | 7/1995 |
| JP | 09-003606 | A | 1/1997 |
| JP | 2001-294990 | A | 10/2001 |
| JP | 2002-194507 | A | 7/2002 |
| JP | 2005-139533 | | 6/2005 |
| JP | 2007-092163 | A | 4/2007 |

* cited by examiner

*Primary Examiner* — Jessee R. Roe
(74) *Attorney, Agent, or Firm* — DLA Piper LLP (US)

(57) ABSTRACT

Disclosed is a ferritic stainless steel sheet which has excellent corrosion resistance against sulfuric acid in the high-temperature environment and shows less surface roughness at a bent part which is bent at 90° or more. Specifically disclosed is a ferritic stainless steel sheet which has the following chemical composition: C: 0.02 mass % or less, Si: 0.05 to 0.8 mass %, Mn: 0.5 mass % or less, P: 0.04 mass % or less, S: 0.010 mass % or less, Al: 0.10 mass % or less, Cr: 20 to 24 mass % Cu: 0.3 to 0.8 mass %, Ni: 0.5 mass % or less, Nb: 0.20 to 0.55 mass %, and N: 0.02 mass % or less, with the remainder being Fe and unavoidable impurities; and which has such a structure that the maximum particle diameter of an S-containing precipitate is 5 μm or smaller.

9 Claims, 1 Drawing Sheet

FERRITIC STAINLESS STEEL SHEET HAVING SUPERIOR SULFURIC ACID CORROSION RESISTANCE AND METHOD FOR MANUFACTURING THE SAME

RELATED APPLICATIONS

This is a §371 of International Application No. PCT/JP2008/061501, with an international filing date of Jun. 18, 2008 (WO 2008/156195 A1, published Dec. 24, 2008), which is based on Japanese Patent Application Nos. 2007-163418, filed Jun. 21, 2007, and 2007-178097, filed Jul. 6, 2007, the subject matter of which is incorporated by reference.

TECHNICAL FIELD

This disclosure relates to a ferritic stainless steel sheet having a superior corrosion resistance against sulfuric acid. In addition, besides the above corrosion resistance, relates to a ferritic stainless steel sheet which has a low degree of rough surface at a bent part which is formed by a bending work performed at an angle of 90° or more and to a method for manufacturing the above ferritic stainless steel sheet.

BACKGROUND

Fossil fuels, such as petroleum and coal, contain sulfur (hereinafter represented by "S"). Hence, when a fossil fuel is combusted, S is oxidized, and sulfur oxides such as $SO_2$ are mixed in an exhaust gas. When the temperature of an exhaust gas decreases in a pipe, such as a gas duct, a chimney pipe, or an exhaust gas desulfurizer, fitted to an apparatus (such as an industrial boiler) in which a fossil fuel is combusted, this $SO_x$ gas reacts with moisture in the exhaust gas to form sulfuric acid and, as a result, dewdrops thereof are formed on an inner surface of the pipe. This sulfuric acid in the form of dewdrops enables corrosion (hereinafter referred to as "sulfate corrosion") of the pipe to progress.

Various techniques to prevent the sulfate corrosion have been investigated and, for example, there has been used a technique in which a pipe for an exhaust gas is formed from low-alloy steel or a technique in which the temperature of an exhaust gas is controlled to 150° C. or more.

However, by the techniques described above, although the sulfate corrosion may be suppressed, it is difficult to stop the progression thereof.

In recent years, concomitant with an expansion of automobile market in Asia, iron steel has been increasingly in demand, and the amount of fossil fuels consumed in blast furnaces, heat treat furnaces, and the like of steel industry has also been increased. Hence, development of techniques to prevent the sulfate corrosion has become an urgent requirement in the steel industry. In addition, since gasoline contains S, the sulfate corrosion is also generated in pipes for exhaust gases emitted from automobile engines. Accordingly, exhaust gas pipes of automobiles also require a technique to prevent the sulfate corrosion. In addition, many of these pipes are subjected to a severe bending work.

Since high-temperature exhaust gases pass through exhaust gas pipes of blast furnaces, heat treat furnaces, and automobiles, low-alloy steel has not been used to prevent high-temperature oxidation, but ferritic stainless steel has been used in many cases. Hence, various techniques to improve the resistance against the sulfate corrosion (hereinafter referred to as "sulfate corrosion resistance") of ferritic stainless steel have been studied.

For example, in Japanese Unexamined Patent Application Publication No. 56-146857, a technique has been disclosed in which acid resistance is improved by decreasing the S content of ferritic stainless steel to 0.005 mass percent or less. However, in Japanese Unexamined Patent Application Publication No. 56-146857, the acid resistance is investigated by dipping ferritic stainless steel in boiling hydrochloric acid, and the sulfate corrosion resistance has not been disclosed.

In Japanese Unexamined Patent Application Publication No. 7-188866, a technique has been disclosed in which, to suppress intergranular corrosion caused by nitric acid, the contents of C and N of ferritic stainless steel are decreased, and the contents of Mn, Ni, and B are also defined. However, according to the generation mechanism of intergranular corrosion caused by nitric acid, an environmental potential becomes positive due to the presence of nitric ions, and hence the breakage behavior of a passivation film of stainless steel and the stability of corrosion products are different from those caused by the sulfate corrosion. Accordingly, to apply the technique disclosed in Japanese Unexamined Patent Application Publication No. 7-188866 to prevent the sulfate corrosion, further study must be carried out.

To improve the formability of a ferritic stainless steel sheet, there has been investigated a technique in which the amounts of C and N are considerably decreased in a refining step of molten steel which is used as a raw material or a technique in which C and/or N is stabilized by the formation of carbides and/or nitrides by addition of Ti and/or Nb to molten steel. As a result, a ferritic stainless steel sheet having superior deep drawing characteristics to those of an austenite stainless steel sheet has been developed. However, according to a related ferritic stainless steel sheet having superior deep drawing characteristics, the formability by a deep drawing work, which is evaluated, for example, by a Lankford value (so-called r value), is improved.

In addition, to reduce the degree of rough surface (so-called "orange peel") at a bent part formed by stretch forming, a technique has been investigated to improve a method for forming a ferritic stainless steel sheet into a predetermined shape (for example, see Japanese Unexamined Patent Application Publication No. 2005-139533). However, the rough surface at a bent part is not only generated by stretch forming but is also generated, for example, by a bending work, and research on a technique for reducing the degree of rough surface at a bent part by improving components of a ferritic stainless steel sheet and a manufacturing method therefor has not been sufficiently carried out.

The rough surface is a collective term including various surface defects, and in a ferritic stainless steel sheet, a rough surface, which is called "ridging," is frequently generated. The ridging indicates a surface defect which is caused by the difference in deformation between individual textures which is generated when the textures are processed in a rolling direction generated by rolling. Although steel which suppresses the generation of ridging has been disclosed in many reports, even when the steel described above is used, a rough surface at a bent part may be apparently observed in some cases. Accordingly, it is believed that the generation mechanism of the rough surface at a bent part is different from that of the ridging, and hence measures suitable for the respective problems are separately required. In particular, when a bending work is performed at an angle of 90° or more, the rough surface is apparently generated.

Accordingly, it could be helpful to provide a ferritic stainless steel sheet and a method for manufacturing the same, the ferritic stainless steel sheet having a superior sulfate corrosion resistance even in a high-temperature atmosphere and further having a low degree of rough surface at a bent part formed by a bending work performed at an angle of 90° or more.

SUMMARY

We carried out intensive research on the generation mechanism of sulfate corrosion of ferritic stainless steel sheets. It has been understood that inclusions containing S (hereinafter referred to as "sulfur-containing inclusions") function as initiation points of the sulfate corrosion. However, since the sulfur-containing inclusions are dissolved when brought into contact with sulfuric acid, the sulfur-containing inclusions are not frequently observed at portions at which the sulfate corrosion occurs. Accordingly, we focused on the sulfur-containing inclusions before the sulfate corrosion occurs and investigated the influence of the grain diameter of the sulfur-containing inclusions on the progression of the sulfate corrosion.

As a result, the following findings which are effective to prevent the sulfate corrosion were obtained. They are:

(a) the S content is decreased to suppress precipitation of the sulfur-containing inclusions;

(b) fine NbC grains are dispersed and precipitated by maintaining the Nb content in an appropriate range, and the sulfur-containing inclusions (such as MnS) are made to adhere to the precipitated NbC grains so that the sulfur-containing inclusions are refined; and (c) a passivation film is modified by maintaining the Cu content in an appropriate range so as to suppress dissolution of base iron.

In addition, we investigated the mechanism in which the rough surface (different from the ridging) is generated at a bent part formed by performing a bending work on a ferritic stainless steel sheet. As a result, the relationship between the average grain diameter of ferrite crystal grains at a bent part and a rough-surface depth was discovered. That is, we found that as the average grain diameter of ferrite crystal grains at a bent part is decreased, the rough-surface depth at the bent part is decreased.

In addition, we found that when dislocation movement caused by a bending work is disturbed by dispersing fine NbC grains to generate work hardening at a bent part, the bent part is uniformly processed, and the degree of rough surface is reduced.

That is, we provide a ferritic stainless steel sheet comprising: a composition which contains 0.02 mass percent or less of C, 0.05 to 0.8 mass percent of Si, 0.5 mass percent or less of Mn, 0.04 mass percent or less of P, 0.010 mass percent or less of S, 0.10 mass percent or less of Al, 20 to 24 mass percent of Cr, 0.3 to 0.8 mass percent of Cu, 0.5 mass percent or less of Ni, 0.20 to 0.55 mass percent of Nb, 0.02 mass percent or less of N, and the balance being Fe and inevitable impurities; and a structure in which the maximum grain diameter of inclusions containing S is 5 μm or less.

The ferritic stainless steel sheet can include the composition described above, wherein the Ni content is 0.3 mass percent or less, and the Nb content is 0.20 to 0.50 mass percent.

The ferritic stainless steel sheet can include, in addition to the above composition, at least one selected from the group consisting of 0.005 to 0.5 mass percent of Ti, 0.5 mass percent or less of Zr, and 1.0 mass percent or less of Mo is contained.

In addition, the ferritic stainless steel sheet can include in the composition the content of C and the content of N, each being 0.001 to 0.02 mass percent, the average grain diameter of ferrite crystal grains is 30.0 μm or less, and the maximum grain diameter of precipitated NbC grains is 1 μM or less.

In addition, we provide a method for manufacturing a ferritic stainless steel sheet comprising: performing hot rolling of a slab or an ingot which contains 0.02 mass percent or less of C, 0.05 to 0.8 mass percent of Si, 0.5 mass percent or less of Mn, 0.04 mass percent or less of P, 0.010 mass percent or less of S, 0.10 mass percent or less of Al, 20 to 24 mass percent of Cr, 0.3 to 0.8 mass percent of Cu, 0.5 mass percent or less of Ni, 0.20 to 0.55 mass percent of Nb, 0.02 mass percent or less of N, and the balance being Fe and inevitable impurities at a finishing temperature of 700° C. to 950° C., performing cooling at an average cooling rate of 20° C./sec or more from the finishing temperature to a coiling temperature, and performing coiling at a coiling temperature of 600° C. or less.

In addition, in the method for manufacturing a ferritic stainless steel sheet, the finishing temperature is 700° C. to 900° C., and the coiling is performed at a coiling temperature of 570° C. or less.

In addition, in the method for manufacturing a ferritic stainless steel sheet, a hot-rolled steel sheet is annealed at 900° C. to 1,200° C., and after pickling and cold rolling are performed, annealing is performed at an annealing temperature of less than 1,050° C.

In addition, in the method for manufacturing a ferritic stainless steel sheet, the hot-rolled steel sheet is annealed at 900° C. to 1,100° C., and after pickling and cold rolling are performed, annealing is performed at an annealing temperature of less than 900° C.

In addition, we provide a method for manufacturing a ferritic stainless steel sheet which comprises: performing hot rolling of a slab or an ingot which contains 0.001 to 0.02 mass percent of C, 0.05 to 0.3 mass percent of Si, 0.5 mass percent or less of Mn, 0.04 mass percent or less of P, 0.01 mass percent or less of S, 0.10 mass percent or less of Al, 20 to 24 mass percent of Cr, 0.3 to 0.8 mass percent of Cu, 0.5 mass percent or less of Ni, 0.20 to 0.55 mass percent of Nb, 0.001 to 0.02 mass percent of N, and the balance being Fe and inevitable impurities at a finishing temperature of 770° C. or less and a coiling temperature of 450° C. or less, and further performing cold rolling at a draft of 50% or more.

In addition, in the method for manufacturing a ferritic stainless steel sheet, cooling is performed from the finishing temperature to the coiling temperature at an average cooling rate of 20° C./sec or more.

A ferritic stainless steel sheet having a superior sulfate corrosion resistance even in a high-temperature atmosphere can thus be obtained.

In addition, a ferritic stainless steel sheet can be obtained which has a low degree of rough surface at a bent part formed by a bending work performed at an angle of 90° or more as well as the characteristics described above.

DETAILED DESCRIPTION

Figure 1:
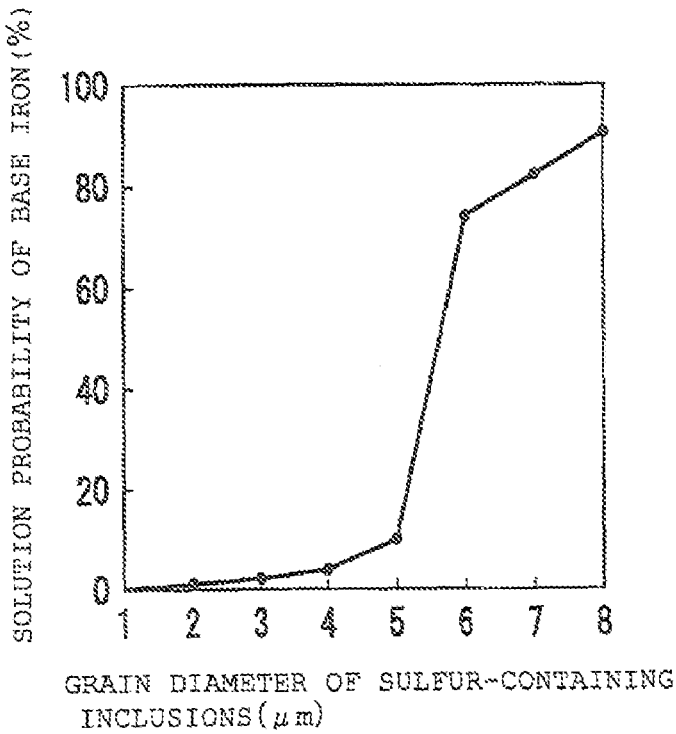
FIG. 1 is a graph showing the relationship between the grain diameter of sulfur-containing inclusions and the solution probability of base iron.

First, the reasons for specifying the components of a ferritic stainless steel sheet will be described.

C: 0.02 Mass Percent or Less

C is an element to increase the strength of a ferritic stainless steel sheet. To obtain the above effect, the content is preferably 0.001 mass percent or more. However, when the C content is more than 0.02 mass percent, since a ferritic stainless steel sheet is hardened, the press formability is degraded and, in addition, since C binds to Nb and N, which will be described later, to precipitate a coarse Nb carbonitride, the sulfate corrosion resistance is degraded. Hence, the C content is set to 0.02 mass percent or less. More preferably, the content is 0.015 mass percent or less.

In addition, in view of the degree of rough surface at a bent part, when the C content is less than 0.001 mass percent, precipitation of NbC grains which function as production nuclei of ferrite crystal grains is disturbed. On the other hand, when the C content is more than 0.02 mass percent, the formability and the corrosion resistance are not only degraded, but also NbC grains are coarsened. Hence, the C content is set in the range of 0.001 to 0.02 mass percent. More preferably, the content is 0.002 to 0.015 mass percent.

Si: 0.05 to 0.8 Mass Percent

Si is used as a deoxidizing agent in a steelmaking process for forming ferritic stainless steel. When the Si content is less than 0.05 mass percent, a sufficient deoxidizing effect cannot be obtained. Hence, a large amount of oxides is precipitated on a manufactured ferritic stainless steel sheet, and the weldability and the press formability are degraded. On the other hand, when the content is more than 0.8 mass percent, since a ferritic stainless steel sheet is hardened, the workability is degraded and, as a result, manufacturing of a ferritic stainless steel sheet may have some problems. Hence, the Si content is set in the range of 0.05 to 0.8 mass percent. More preferably, the content is 0.05 to 0.3 mass percent. Even more preferably, the content is 0.06 to 0.28 mass percent.

Mn: 0.5 Mass Percent

Mn is used as a deoxidizing agent in a steelmaking process for forming a ferritic stainless steel. To obtain the above effect, the content is preferably 0.01 mass percent or more. When the Mn content is more than 0.5 mass percent, the workability of a ferritic stainless steel sheet is degraded by solid solution strengthening. In addition, Mn binds to S which will be described later to facilitate precipitation of MnS and, as a result, the sulfate corrosion resistance is degraded. Hence, the Mn content is set to 0.5 mass percent or less. More preferably, the content is 0.3 mass percent or less.

P: 0.04 Mass Percent or Less

Although not responsible for the sulfate corrosion, P is an element to cause various types of corrosion, and hence the content thereof must be decreased. In particular, when the P content is more than 0.04 mass percent, besides the corrosion problem, due to segregation of P in crystal grain boundaries, the workability of a ferritic stainless steel sheet is degraded. As a result, manufacturing of a ferritic stainless steel sheet may have some problems. Hence, the P content is set to 0.04 mass percent or less. More preferably, the content is 0.03 mass percent or less.

S: 0.010 Mass Percent or Less

S is an element which binds to Mn or the like to generate sulfur-containing inclusions (such as MnS). Hence, a lower S content is more preferable. However, when the content is less than 0.0005 mass percent, desulfurization is difficult to perform and, as a result, the manufacturing load is increased. Accordingly, the content is preferably 0.0005 mass percent or more. When the sulfur-containing inclusions are in contact with sulfuric acid and are dissolved, hydrogen sulfide is generated and the pH locally decreases. A passivation film is not formed just under sulfur-containing inclusions precipitated on a surface of a ferritic stainless steel sheet, and even after the sulfur-containing inclusions are dissolved, no passivation film is formed since the pH is low. As a result, base iron is exposed to sulfuric acid and the sulfate corrosion progresses. When the S content is more than 0.010 mass percent, a large amount of the sulfur-containing inclusions is precipitated, so that the sulfate corrosion apparently occurs. Hence, the S content is set to 0.010 mass percent or less. More preferably, the content is 0.008 mass percent or less.

Al: 0.10 Mass Percent or Less

Al is used as a deoxidizing agent in a steelmaking process for forming a ferritic stainless steel. In addition, Al is added to precipitate N in steel in the form of AlN which is precipitated at a higher temperature than that at which a Nb carbonitride is precipitated, and thereby the N amount which binds to Nb is decreased, so that precipitation of a coarse Nb carbonitride is suppressed. Hence, Nb is precipitated in the form of fine NbC grains, and as a result, refining of ferrite crystal grains and suppression of coarsening of the sulfur-containing inclusions are effectively performed. In addition, since precipitated AlN grains are very fine, dislocation movement in a bending work is disturbed, and the work hardening of steel is facilitated, so that uniform deformation of a bent part can be effectively performed. To obtain the above effect, the content is preferably 0.005 mass percent or more. However, when the Al content is more than 0.10 mass percent, since Al-based nonmetal inclusions are increased, surface defects, such as surface scratches, of a ferritic stainless steel sheet are caused thereby, and the workability is also degraded. Accordingly, the Al content is set to 0.10 mass percent or less. More preferably, the content is 0.08 mass percent or less.

Cr: 20 to 24 Mass Percent

Cr is an element to improve the sulfate corrosion resistance of a ferritic stainless steel sheet. When the Cr content is less than 20 mass percent, a sufficient sulfate corrosion resistance cannot be obtained. On the other hand, when the content is more than 24 mass percent, a σ phase is liable to be generated, and the press formability of a ferritic stainless steel sheet is degraded. Hence, the Cr content is set in the range of 20 to 24 mass percent. More preferably, the content is 20.5 to 23.0 mass percent.

Cu: 0.3 to 0.8 Mass Percent

After the sulfate corrosion occurs in a ferritic stainless steel sheet, Cu has a function to suppress the dissolution of base iron caused by an anode reaction. In addition, Cu also has a function to modify a passivation film present around each sulfur-containing inclusion. Cu present in the vicinity of sulfur-containing inclusions generates distortion in the crystal lattice of base iron. A passivation film formed on the distorted crystal lattice becomes denser than a passivation film formed on a normal crystal lattice. When the passivation film is modified as described above, the sulfate corrosion resistance of a ferritic stainless steel sheet is improved. When the Cu content is less than 0.3 mass percent, the above effect cannot be obtained. On the other hand, when the content is more than 0.8 mass percent, Cu is corroded by sulfuric acid, and from the corroded Cu, the sulfate corrosion of a ferritic stainless steel sheet progresses. In addition, since hot workability is degraded, manufacturing of a ferritic stainless steel sheet may have some problems. Hence, the Cu content is set in the range of 0.3 to 0.8 mass percent. More preferably, the content is 0.3 to 0.6 mass percent.

Ni: 0.5 Mass Percent or Less

Ni has a function to suppress an anode reaction caused by sulfuric acid and to maintain a passivation film even when the pH decreases. To obtain the above effect, the content is preferably 0.05 mass percent or more. However, when the Ni content is more than 0.5 mass percent, a ferritic stainless steel sheet is hardened, and the press formability is degraded. Hence, the Ni content is set to 0.5 mass percent or less. More preferably, the content is 0.3 mass percent or less. Even more preferably, the content is 0.2 mass percent or less.

Nb: 0.20 to 0.55 Mass Percent

Nb fixes C and N and has a function to prevent sensitization to corrosion by a Cr carbonitride. In addition, Nb also has a function to improve resistance to oxidation at a high temperature of a ferritic stainless steel sheet. Besides the effects described above, Nb is an important element that refines ferrite crystal grains by dispersing fine inclusions (that is, NbC). NbC grains function as product nuclei of recrystallization grains when a cold-rolled ferritic stainless steel sheet is annealed. Hence, when NbC grains are dispersed and precipitated, fine ferrite crystal grains are generated. Furthermore, NbC disturbs movement of grain boundaries in a generation process of ferrite crystal grains and disturbs the growth thereof. Hence, an effect of maintaining fine ferrite crystal grains can be obtained. That is, when fine NbC grains are dispersed, refining of ferrite crystal grains can be achieved. In addition, fine NbC grains dispersed in and precipitated on a ferritic stainless steel sheet disturbs dislocation movement caused by a bending work and causes work hardening at a bent part. As a result, since deformation by a bending work is sequentially moved to a region having a small deformation resistance, the bent part is uniformly processed, and the degree of rough surface is reduced. In addition, when fine NbC grains are dispersed and precipitated, sulfur-containing inclusions adhere thereto and are precipitated, and the grain diameter thereof is decreased. Even when a sulfur-containing inclusion having a decreased grain diameter is dissolved in sulfuric acid, since the pH is suppressed from decreasing, a solution therearound can maintain a lower limit pH or more at which stainless steel can form a passivation film, and as a result, stainless steel just below the sulfur-containing inclusion can be re-passivated immediately after the sulfur-containing inclusion is dissolved. Hence, dissolution of the S-containing inclusion does not initiate the corrosion, and hence the sulfate corrosion resistance is improved. When the Nb content is less than 0.20 mass percent, the above effect cannot be obtained. On the other hand, when the content is more than 0.55 mass percent, NbC grains are coarsened, and ferrite crystal grains and sulfur-containing inclusions are both coarsened. Hence, the Nb content is set in the range of 0.20 to 0.55 mass percent. More preferably, the content is 0.20 to 0.5 mass percent. Even more preferably, the content is 0.25 to 0.45 mass percent.

N: 0.02 Mass Percent or Less

N is solid-solved in a ferritic stainless steel sheet and has a function to improve the sulfate corrosion resistance. To obtain the above effect, the content is preferably 0.001 mass percent or more. However, when the content is excessive, as in the case of C, since precipitation of a coarse Nb carbonitride is facilitated, the sulfate corrosion resistance of a ferritic stainless steel sheet is degraded and, in addition, the degree of rough surface at a bent part is degraded. In particular, when the N content is more than 0.02 mass percent, besides the sulfate corrosion problem, the press formability of a ferritic stainless steel sheet is also degraded. Hence, the N content is set to 0.02 mass percent or less. More preferably, the content is 0.015 mass percent or less.

Furthermore, at least one selected from the group consisting of Ti, Zr, and Mo is preferably contained.

Ti: 0.005 to 0.5 Mass Percent

Since Ti binds to C and N to form a Ti carbonitride, C and N are fixed, and hence, Ti has a function to prevent sensitization to corrosion caused by a Cr carbonitride. Hence, by addition of Ti, the sulfate corrosion resistance can be further improved. When the Ti content is less than 0.005 mass percent, the above effect cannot be obtained. On the other hand, when the content is more than 0.5 mass percent, a ferritic stainless steel sheet is hardened, so that the press formability is degraded. Hence, when Ti is added, the Ti content is preferably in the range of 0.005 to 0.5 mass percent. More preferably, the content is 0.1 to 0.4 mass percent.

Zr: 0.5 Mass Percent or Less

As in the case of Ti, since Zr binds to C and N to form a Zr carbonitride, C and N are fixed and, hence, Zr has a function to prevent sensitization to corrosion caused by a Cr carbonitride. To obtain the above effect, the content is preferably 0.01 mass percent or more. Hence, by addition of Zr, the sulfate corrosion resistance can be further improved. However, when the Zr content is more than 0.5 mass percent, a large amount of Zr oxides (that is, $ZrO_2$ and the like) is generated, surface cleanness of a ferritic stainless steel sheet is degraded. Hence, when Zr is added, the Zr content is preferably 0.5 mass percent or less. More preferably, the content is 0.4 mass percent or less.

Mo: 1.0 Mass Percent or Less

Mo has a function to improve the sulfate corrosion resistance. To obtain the above effect, the content is preferably 0.1 mass percent or more. However, when the Mo content is more than 1.0 mass percent, the effect is saturated. That is, even when more than 1.0 mass percent of Mo is added, improvement in sulfate corrosion resistance corresponding to the addition amount cannot be expected, and on the other hand, since a large amount of expensive Mo is used, a manufacturing cost of a ferritic stainless steel sheet is increased. Hence, when Mo is added, the Mo content is preferably 1.0 mass percent or less. More preferably, the content is 0.8 mass percent or less.

In addition, since Mg has no contribution, a lower content is more preferable, and the content is preferably equivalent to or less than that of inevitable impurities.

The balance other than those components described above contains Fe and inevitable impurities.

Next, the structure of the ferritic stainless steel sheet will be described.

Maximum Grain Diameter of Sulfur-Containing Inclusions: 5 μm or Less

We manufactured ferritic stainless steel sheets having various components and investigated the relationship between the size of sulfur-containing inclusions and the progression of the sulfate corrosion. The investigation method and the investigation results will be described.

After ferritic stainless steel having components shown in Table 1 was formed by melting and further formed into a slab, hot rolling (finishing temperature: 800° C., coiling temperature: 450° C., and sheet thickness: 4 mm) was performed by heating to 1,170° C., so that a hot-rolled steel sheet was formed. An average cooling rate from finish rolling to coiling (that is, from 800° C. to 450° C.) was set to 20° C./sec.

The hot-rolled steel sheet thus obtained was annealed at 900° C. to 1,200° C. for 30 to 300 seconds and further processed by pickling. Next, after cold rolling was performed, annealing was performed at 970° C. for 30 to 300 seconds and was further processed by pickling, so that a ferritic stainless steel sheet (sheet thickness: 0.8 mm) was formed.

A test piece (width: 30 mm, and length: 50 mm) was cut out of the ferritic stainless steel sheet thus obtained, and two surfaces of the test piece were polished with #600 abrasive paper and were then observed using a scanning electron microscope (so-called SEM). The grain diameter of a Nb carbonitride was approximately several micrometers, and the grain diameter of a Nb carbide was approximately 1 μm. In addition, it was confirmed that sulfur-containing inclusions (such as MnS) adhere to peripheries of the Nb carbonitride and the Nb carbide and are precipitated. The grain diameters of all sulfur-containing inclusions in one arbitrary viewing field having a size of 10 mm square were measured. The grain diameter was defined as the maximum length of the longitudinal axis. The grain diameter of the maximum sulfur-containing inclusion among those thus measured was regarded as the maximum grain diameter.

Subsequently, after the test piece was immersed in sulfuric acid (concentration: 10 mass percent, and temperature: 50° C.) for 1 hour, the surface of the test piece was observed by a SEM. The Nb carbonitride and the Nb carbide observed before the immersion were dissolved together with the sulfur-containing inclusions, and at the positions thereof, dimples which were supposed to be formed by dissolution of base iron were generated. Although some inclusions remained on the test piece, S was not detected from the inclusions.

As described above, the relationship between the grain diameter of the sulfur-containing inclusions before the immersion in sulfuric acid and the solution probability of base iron by the immersion was investigated. The results are shown in FIG. 1. In this case, the solubility probability is a value (=100×M/N) obtained by dividing a number M by a total number N of inclusions having a predetermined size before the immersion, the number M being the number of base-iron dissolution points which are confirmed at places at which the inclusions having a predetermined size are present before the immersion.

As apparent from FIG. 1, when the maximum grain diameter of the sulfur-containing inclusions is 5 μm or less, the solution probability of the base iron is considerably decreased. This phenomenon indicates that when the maximum grain diameter of the sulfur-containing inclusions is 5 μm or less, the sulfate corrosion can be prevented. Hence, the maximum grain diameter of the sulfur-containing inclusions is set to 5 μm or less.

Next, the structure of the ferritic stainless steel sheet which has a low degree of rough surface at a bent part formed by a bending work will be described.

Average Grain Diameter of Ferrite Crystal Grains: 30.0 μm or Less

A rough-surface depth at a bent part formed by a bending work has the relationship with the average grain diameter of ferrite crystal grains. Since ferrite crystal grains are each formed to have a pancake like shape when receiving a tensile stress by a bending work, spaces are generated between adjacent ferrite crystal grains, so that the rough surface is generated. When bending work is performed to a predetermined level, the ratio of the major axis of a deformed pancake like ferrite crystal grain to the minor axis thereof is constant regardless of the size of ferrite crystal grains having an approximately spherical shape before a bending work is performed. The rough-surface depth is proportional to the minor axis of a ferrite crystal grain having a pancake like shape, and this minor axis is proportional to the size of the ferrite crystal grain before a bending work is performed. That is, as the average grain diameter of ferrite crystal grains is decreased, the rough-surface depth is decreased. When the average grain diameter of ferrite crystal grains is 30.0 μm or less, even if a bending work is performed at an angle of 90° or more, the degree of rough surface at a bent part can be reduced to a level at which no problems may occur. Hence, the average grain diameter of ferrite crystal grains is set to 30.0 μm or less. More preferably, the average grain diameter is 20.0 μm or less. By the way, the average grain diameter was obtained in accordance with ASTM E 112, and after the grain diameters of ferrite crystal grains in three arbitrary viewing fields were measured by an intercept method, the average value of the grain diameters was calculated.

Maximum Grain Diameter of NbC Grains: 1 μm or Less

As described above, when fine NbC grains are dispersed in a ferritic stainless steel sheet, since recrystallization of ferrite crystal grains is facilitated, and the growth thereof is disturbed, the ferrite crystal grains can be refined. When the maximum grain diameter of precipitated NbC grains is more than 1 μm, the above effect cannot be obtained. In addition, when NbC grains are coarsened, a stress is concentrated by a bending work and, as a result, local deformation is liable to occur. Accordingly, the maximum grain diameter of NbC grains is set to 1 μm or less. The grain diameter of the largest one among NbC inclusions observed in one arbitrary viewing field having a size of 10 mm square was measured. The maximum length of the long axis was regarded as the maximum grain diameter.

Hereinafter, one example of a preferable method for manufacturing the ferritic stainless steel sheet will be described.

After a ferritic stainless steel having predetermined components is formed by melting and further formed into a slab, hot rolling (finishing temperature: 700° C. to 950° C., more preferably 900° C. or less, and even more preferably 770° C. or less; coiling temperature: 600° C. or less, preferably 570° C. or less, and even more preferably 450° C. or less; and sheet thickness: 2.5 to 6 mm) is performed by heating to 1,100° C. to 1,200° C., so that a hot-rolled steel sheet is obtained. To prevent sulfur-containing inclusions and ferrite crystal grains from being coarsened from finish rolling to coiling, cooling from the finishing temperature to the coiling temperature is performed at an average cooling rate of 20° C./sec or more.

A cooling rate after the coiling is not particularly limited. However, since the toughness of the hot-rolled steel sheet is degraded at approximately 475° C. (so-called 475° C. brittleness), the average cooling rate in a temperature range of 525° C. to 425° C. is preferably 100° C./hour or more.

Next, the hot-rolled steel sheet is annealed at 900° C. to 1,200° C. and more preferably at 900° C. to 1,100° C. for 30 to 240 seconds and is further processed by pickling. Furthermore, after cold rolling (preferably at a draft of 50% or more) is performed, annealing and pickling are performed to form a ferritic stainless steel sheet. To prevent the sulfur-containing inclusions from being coarsened, annealing after the cold rolling is preferably performed at less than 1,050° C. and more preferably at less than 900° C. for 10 to 240 seconds. When the annealing temperature is 900° C. or more, a time at a heating temperature of 900° C. or more is preferably set to 1 minute or less.

The above-described ferritic stainless steel sheet has a superior sulfate corrosion resistance even in a high-temperature atmosphere because of the synergetic effect of the intrinsic characteristics of ferritic stainless steel, that is, superior corrosion resistance in a high-temperature atmosphere, and the intrinsic characteristics disclosed in the above (a) to (c). Furthermore, since the ferrite crystal grains are fine, even when a bending work is performed at an angle of 90° or more, the space between adjacent ferrite crystal grains is decreased to a level at which no problems may occur. Hence, the degree of rough surface is reduced.

EXAMPLE 1

After ferritic stainless steel having components shown in Table 1 was formed by melting and was further formed into a slab, hot rolling (finishing temperature: 800° C., coiling temperature: 450° C., and sheet thickness: 4 mm) was performed by heating to 1,170° C., so that a hot-rolled steel sheet was formed. An average cooling rate from finish rolling to coiling (that is, from 800° C. to 450° C.) was set to 20° C./sec.

The hot-rolled steel sheet thus obtained was annealed at 900° C. to 1,200° C. for 30 to 300 seconds and was further processed by pickling. Next, after cold rolling was performed, annealing was performed at 970° C. for 30 to 300 seconds and was further processed by pickling, so that a ferritic stainless steel sheet (sheet thickness: 0.8 mm) was obtained.

The ferritic stainless steel sheet thus obtained was cut into a sheet having a width of 30 mm and a length of 50 mm, and two surfaces of this sheet was polished with #600 abrasive paper, so that a test piece was prepared. This test piece was observed using a scanning electron microscope (so-called SEM), and grain diameters of all sulfur-containing inclusions present in one arbitrary viewing field having a size of 10 mm square were measured. The maximum length of the long axis was regarded as the grain diameter. The grain diameter of the largest one among the measured sulfur-containing inclusions was regarded as the maximum grain diameter. The results are shown in Table 2. Furthermore, the mass of the test piece was measured.

Next, after the test piece was immersed in sulfuric acid (concentration: 10 mass percent, and temperature: 50° C.) for 48 hours, the mass of the test piece was measured, so that the sulfate corrosion resistance was investigated. For the sulfate corrosion resistance, the change in mass of the test piece before and after the immersion was calculated. When the change in mass of the test piece with respect to the mass thereof before the immersion was less than 10%, it was evaluated as Good (○), and when the change in mass was 10% or more, it was evaluated as No good (x). The results are shown in Table 2.

A1 to A4 shown in Table 2 are examples in which the Cu content was changed. According to A2 and A3 which were within our range, a superior sulfate corrosion resistance was obtained. B1 to B4 shown in Table 2 are examples in which the S content was changed. According to B1 to B3 which were within our range, a superior sulfate corrosion resistance was obtained. C1 to C5 shown in Table 2 are examples in which the Nb content was changed. According to C2 to C4 which were within our range, a superior sulfate corrosion resistance was obtained. D1 to D4 shown in Table 2 are examples in which the maximum grain diameter of the sulfur-containing inclusions was changed. According to D1 and D2 which were within our range, a superior sulfate corrosion resistance was obtained. E1 to E7 shown in Table 2 are examples in which at least one of Ti, Zr, and Mo was further added as an additional element. According to E1 to E7 which were within our range, a superior sulfate corrosion resistance was obtained.

On the other hand, A1 and A4 shown in Table 2 are comparative examples in which the Cu content was out of our range. B4 is a comparative example in which the S content was out of our range. C1 and C5 are comparative examples in which the Nb content was out of our range. D3 and D4 are comparative examples in which the maximum grain diameter of the sulfur-containing inclusions was out of our range. In addition, E8 to E10 are comparative examples in which the content of at least one of Al, Cr, Nb, and N was out of our range. According to the comparative examples which were out of our range, a superior sulfate corrosion resistance could not be obtained.

EXAMPLE 2

In addition to the confirmation of the effect on the sulfate corrosion resistance, the effect on the degree of rough surface at a bent part formed by a bending work performed at an angle of 90° or more was further confirmed.

After ferritic stainless steel having components shown in Table 3 was formed by melting and was then processed by continuous casting, hot rolling of an obtained slab was performed by heating to 1,170° C. The finishing temperature and the coiling temperature are shown in Table 4. Among slabs of Nos. 1 to 29 shown in Table 3, No. 1 and No. 5 are examples in which the Nb content was out of our range; No. 13 is an example in which the Cu content was out of our range; No. 28 is an example in which the C content was out of range; and the other Nos. were all within our range.

Obtained hot-rolled steel sheets were cooled from the finishing temperature to the coiling temperature of the hot rolling at an average cooling rate of 25° C./sec. The hot-rolled steel sheets were annealed at 900° C. to 1,100° C. (however, only No. 9 was annealed at 1,150° C.) and were further processed by pickling to remove scale. Next, after cold rolling was performed, annealing (heating temperature: 970° C., and heating time: 90 seconds) and pickling were further performed, so that ferritic stainless steel sheets (sheet thickness: 0.8 mm) were obtained. The finishing temperature of the hot rolling, the coiling temperature thereof, and the draft of the cold rolling are shown in Table 4. Nos. 9, 17, 21, 25, and 29 are examples in which at least one of the finishing temperature of the hot rolling, the coiling temperature thereof, the annealing temperature for the hot-rolled steel sheet, and the draft of the cold rolling was out of our range.

After an arbitrary cross section of the ferritic stainless steel sheet was etched with diluted aqua regia, grain diameters of ferrite crystal grains in 3 arbitrary viewing fields were measured by an intercept method in accordance with ASTM E 112, and the average value of the grain diameters was calculated. The results are shown in Table 4.

In addition, an arbitrary cross section of the ferritic stainless steel sheet was observed by a scanning electron microscope (so-called SEM), and the maximum grain diameter of precipitated NbC grains was measured. Among NbC inclusions in one arbitrary viewing field having a size of 10 mm square, the grain diameter of the largest one was measured. The maximum long axis length was regarded as the maximum grain diameter. The results are shown in Table 4.

Furthermore, after a sample having a width of 20 mm and a length of 70 mm was cut out of the ferritic stainless steel sheet, two surfaces of the sample were polished with #600 abrasive paper, and a bending work was then performed. The bending work was performed in such a way that the sample was bent at angle of 180° by pressing a central portion thereof with a punch having a radius of 10 mm.

Figure 2:
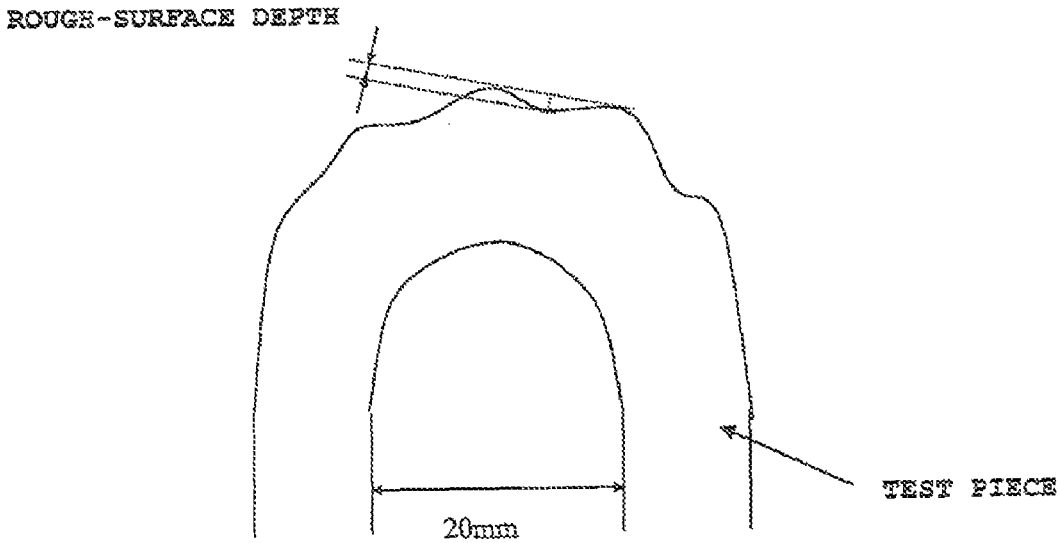
FIG. 2 is a schematic view showing a method for measuring a rough-surface depth at a bent part.

After the bending work was performed, the cross section of the bent part in 3 arbitrary viewing fields was observed, and the rough-surface depth was measured. A method for measuring the rough-surface depth is shown in FIG. 2. After the cross section of the bent part was enlarged at a magnification of 1,000 using an optical microscope, a photograph of the cross section was taken, and as shown in FIG. 2, the largest difference between adjacent convex and concave portions of the rough surface on the cross section of the observed bent part was regarded as the rough-surface depth. A rough-surface depth of 30 μm or less was evaluated as Good (○), and a rough-surface depth of more than 30 μm was evaluated as No good (x). The results are shown in Table 4.

As apparent from Table 4, according to our examples, the rough-surface depths were all 30 μm or less; however, according to comparative examples, the depths were more than 30 μm.

In addition, although not described here, the effect on the sulfate corrosion resistance was also confirmed, and similar effect to that of Example 1 was also confirmed.

TABLE 1

| | COMPOSITION (mass percent) | | | | | | | | | | | | |
|---|---|---|---|---|---|---|---|---|---|---|---|---|---|
| | C | Si | Mn | P | S | Al | Cr | Ni | Cu | Nb | N | OTHER ELEMENTS | REMARKS |
| A1 | 0.011 | 0.11 | 0.17 | 0.032 | 0.002 | 0.028 | 20.6 | 0.28 | 0.23 | 0.24 | 0.010 | — | COMPARATIVE EXAMPLE |
| A2 | 0.008 | 0.12 | 0.16 | 0.030 | 0.004 | 0.024 | 21.0 | 0.22 | 0.33 | 0.27 | 0.010 | — | INVENTION EXAMPLE |
| A3 | 0.008 | 0.13 | 0.17 | 0.031 | 0.004 | 0.024 | 21.4 | 0.23 | 0.55 | 0.27 | 0.011 | — | INVENTION EXAMPLE |
| A4 | 0.009 | 0.14 | 0.16 | 0.032 | 0.007 | 0.026 | 21.8 | 0.29 | 0.85 | 0.24 | 0.012 | — | COMPARATIVE EXAMPLE |
| B1 | 0.007 | 0.14 | 0.18 | 0.022 | 0.001 | 0.029 | 20.3 | 0.27 | 0.42 | 0.42 | 0.010 | — | INVENTION EXAMPLE |
| B2 | 0.007 | 0.14 | 0.19 | 0.020 | 0.005 | 0.028 | 20.5 | 0.25 | 0.43 | 0.38 | 0.009 | — | INVENTION EXAMPLE |
| B3 | 0.008 | 0.15 | 0.18 | 0.022 | 0.008 | 0.029 | 20.8 | 0.25 | 0.45 | 0.38 | 0.009 | — | INVENTION EXAMPLE |
| B4 | 0.007 | 0.16 | 0.18 | 0.027 | 0.014 | 0.029 | 20.4 | 0.27 | 0.43 | 0.40 | 0.009 | — | COMPARATIVE EXAMPLE |
| C1 | 0.008 | 0.13 | 0.17 | 0.031 | 0.004 | 0.033 | 22.4 | 0.28 | 0.23 | 0.16 | 0.011 | — | COMPARATIVE EXAMPLE |
| C2 | 0.010 | 0.12 | 0.18 | 0.030 | 0.008 | 0.052 | 22.5 | 0.27 | 0.35 | 0.27 | 0.014 | — | INVENTION EXAMPLE |
| C3 | 0.009 | 0.14 | 0.16 | 0.032 | 0.007 | 0.049 | 22.7 | 0.29 | 0.33 | 0.35 | 0.012 | — | INVENTION EXAMPLE |
| C4 | 0.009 | 0.14 | 0.15 | 0.032 | 0.007 | 0.035 | 22.7 | 0.29 | 0.30 | 0.46 | 0.012 | — | INVENTION EXAMPLE |
| C5 | 0.010 | 0.12 | 0.18 | 0.030 | 0.008 | 0.044 | 22.5 | 0.26 | 0.29 | 0.58 | 0.014 | — | COMPARATIVE EXAMPLE |
| D1 | 0.012 | 0.24 | 0.28 | 0.028 | 0.008 | 0.025 | 20.8 | 0.28 | 0.32 | 0.39 | 0.013 | — | INVENTION EXAMPLE |
| D2 | 0.011 | 0.25 | 0.25 | 0.027 | 0.008 | 0.016 | 21.0 | 0.29 | 0.57 | 0.41 | 0.015 | — | INVENTION EXAMPLE |
| D3 | 0.009 | 0.24 | 0.28 | 0.028 | 0.009 | 0.022 | 20.9 | 0.28 | 0.46 | 0.40 | 0.008 | — | COMPARATIVE EXAMPLE |
| D4 | 0.011 | 0.25 | 0.24 | 0.029 | 0.009 | 0.021 | 21.1 | 0.28 | 0.45 | 0.39 | 0.010 | — | COMPARATIVE EXAMPLE |
| E1 | 0.011 | 0.16 | 0.17 | 0.029 | 0.002 | 0.021 | 22.1 | 0.22 | 0.48 | 0.25 | 0.010 | Ti: 0.08 | INVENTION EXAMPLE |
| E2 | 0.016 | 0.18 | 0.16 | 0.030 | 0.003 | 0.083 | 22.2 | 0.24 | 0.47 | 0.28 | 0.019 | Zr: 0.03 | INVENTION EXAMPLE |
| E3 | 0.014 | 0.22 | 0.17 | 0.030 | 0.004 | 0.072 | 20.8 | 0.20 | 0.33 | 0.33 | 0.016 | Mo: 0.14 | INVENTION EXAMPLE |
| E4 | 0.011 | 0.16 | 0.15 | 0.029 | 0.002 | 0.046 | 20.1 | 0.29 | 0.45 | 0.27 | 0.013 | Ti: 0.23, Zr: 0.37 | INVENTION EXAMPLE |
| E5 | 0.017 | 0.18 | 0.16 | 0.032 | 0.001 | 0.053 | 23.2 | 0.27 | 0.42 | 0.28 | 0.014 | Zr: 0.11, Mo: 0.27 | INVENTION EXAMPLE |
| E6 | 0.015 | 0.20 | 0.17 | 0.031 | 0.005 | 0.022 | 23.8 | 0.25 | 0.38 | 0.22 | 0.011 | Ti: 0.02, Mo: 0.71 | INVENTION EXAMPLE |
| E7 | 0.018 | 0.54 | 0.18 | 0.029 | 0.001 | 0.022 | 23.7 | 0.28 | 0.32 | 0.23 | 0.012 | Ti: 0.10, Zr: 0.05, Mo: 0.13 | INVENTION EXAMPLE |
| E8 | 0.032 | 0.17 | 0.16 | 0.030 | 0.002 | 0.023 | 24.3 | 0.31 | 0.55 | 0.27 | 0.044 | — | COMPARATIVE EXAMPLE |
| E9 | 0.008 | 0.13 | 0.17 | 0.031 | 0.001 | 0.122 | 19.0 | 0.33 | 0.55 | 0.27 | 0.011 | — | COMPARATIVE EXAMPLE |
| E10 | 0.010 | 0.12 | 0.32 | 0.030 | 0.015 | 0.038 | 24.5 | 0.32 | 0.72 | 0.53 | 0.014 | — | COMPARATIVE EXAMPLE |

TABLE 2

| | MAXIMUM DIAMETER OF S-CONTAINING INCLUSIONS (μm) | CORROSION RESISTANCE IN SULFURIC ACID*1 | REMARKS |
|---|---|---|---|
| A1 | 1.6 | x | COMPARATIVE EXAMPLE |
| A2 | 2.7 | ○ | INVENTION EXAMPLE |
| A3 | 2.5 | ○ | INVENTION EXAMPLE |
| A4 | 3.2 | x | COMPARATIVE EXAMPLE |
| B1 | 2.5 | ○ | INVENTION EXAMPLE |
| B2 | 3.1 | ○ | INVENTION EXAMPLE |
| B3 | 3.3 | ○ | INVENTION EXAMPLE |
| B4 | 4.9 | x | COMPARATIVE EXAMPLE |
| C1 | 4.3 | x | COMPARATIVE EXAMPLE |
| C2 | 2.4 | ○ | INVENTION EXAMPLE |
| C3 | 2.7 | ○ | INVENTION EXAMPLE |
| C4 | 3.1 | ○ | INVENTION EXAMPLE |
| C5 | 4.8 | x | COMPARATIVE EXAMPLE |
| D1 | 2.3 | ○ | INVENTION EXAMPLE |
| D2 | 4.4 | ○ | INVENTION EXAMPLE |
| D3 | 7.5 | x | COMPARATIVE EXAMPLE |
| D4 | 9.2 | x | COMPARATIVE EXAMPLE |
| E1 | 1.5 | ○ | INVENTION EXAMPLE |

TABLE 2-continued

| | MAXIMUM DIAMETER OF S-CONTAINING INCLUSIONS (μm) | CORROSION RESISTANCE IN SULFURIC ACID*1 | REMARKS |
|---|---|---|---|
| E2 | 1.4 | ○ | INVENTION EXAMPLE |
| E3 | 1.8 | ○ | INVENTION EXAMPLE |
| E4 | 1.9 | ○ | INVENTION EXAMPLE |
| E5 | 1.8 | ○ | INVENTION EXAMPLE |
| E6 | 2.2 | ○ | INVENTION EXAMPLE |
| E7 | 0.7 | ○ | INVENTION EXAMPLE |
| E8 | 4.9 | x | COMPARATIVE EXAMPLE |
| E9 | 3.6 | x | COMPARATIVE EXAMPLE |
| E10 | 10.3 | x | COMPARATIVE EXAMPLE |

*1A dissolved amount of less than 10% is represented by ○, and a dissolved amount of 10% or more is represented by x.

TABLE 3

| | COMPOSITION (MASS PERCENT) | | | | | | | | | | | |
|---|---|---|---|---|---|---|---|---|---|---|---|---|
| NO. | C | Si | Mn | P | S | Al | Cr | Ni | Cu | Nb | N | REMARKS |
| 1 | 0.011 | 0.18 | 0.18 | 0.027 | 0.008 | 0.016 | 22.0 | 0.29 | 0.57 | 0.17 | 0.015 | COMPARATIVE EXAMPLE |
| 2 | 0.009 | 0.13 | 0.17 | 0.031 | 0.005 | 0.025 | 21.5 | 0.30 | 0.48 | 0.28 | 0.011 | INVENTION EXAMPLE |
| 3 | 0.012 | 0.18 | 0.18 | 0.029 | 0.001 | 0.021 | 20.7 | 0.28 | 0.32 | 0.44 | 0.010 | INVENTION EXAMPLE |
| 4 | 0.014 | 0.18 | 0.16 | 0.032 | 0.003 | 0.031 | 21.2 | 0.31 | 0.47 | 0.52 | 0.014 | INVENTION EXAMPLE |
| 5 | 0.011 | 0.16 | 0.17 | 0.029 | 0.009 | 0.021 | 23.1 | 0.28 | 0.45 | 0.59 | 0.010 | COMPARATIVE EXAMPLE |
| 6 | 0.011 | 0.16 | 0.17 | 0.029 | 0.002 | 0.021 | 23.1 | 0.28 | 0.45 | 0.38 | 0.010 | INVENTION EXAMPLE |
| 7 | 0.007 | 0.16 | 0.18 | 0.033 | 0.008 | 0.029 | 22.3 | 0.27 | 0.43 | 0.37 | 0.009 | INVENTION EXAMPLE |
| 8 | 0.007 | 0.14 | 0.19 | 0.031 | 0.005 | 0.028 | 22.5 | 0.25 | 0.43 | 0.39 | 0.009 | INVENTION EXAMPLE |
| 9 | 0.011 | 0.18 | 0.18 | 0.027 | 0.008 | 0.016 | 22.0 | 0.29 | 0.57 | 0.38 | 0.014 | COMPARATIVE EXAMPLE |
| 10 | 0.008 | 0.13 | 0.17 | 0.031 | 0.004 | 0.024 | 21.4 | 0.33 | 0.55 | 0.52 | 0.011 | INVENTION EXAMPLE |
| 11 | 0.012 | 0.19 | 0.16 | 0.028 | 0.008 | 0.025 | 23.8 | 0.33 | 0.32 | 0.53 | 0.013 | INVENTION EXAMPLE |
| 12 | 0.011 | 0.22 | 0.17 | 0.031 | 0.005 | 0.022 | 23.8 | 0.30 | 0.33 | 0.49 | 0.011 | INVENTION EXAMPLE |
| 13 | 0.011 | 0.11 | 0.17 | 0.032 | 0.002 | 0.028 | 20.6 | 0.28 | 0.23 | 0.51 | 0.013 | COMPARATIVE EXAMPLE |
| 14 | 0.007 | 0.16 | 0.18 | 0.033 | 0.009 | 0.029 | 22.3 | 0.27 | 0.43 | 0.35 | 0.009 | INVENTION EXAMPLE |
| 15 | | | | | | | | | | | | INVENTION EXAMPLE |
| 16 | | | | | | | | | | | | INVENTION EXAMPLE |
| 17 | | | | | | | | | | | | COMPARATIVE EXAMPLE |
| 18 | 0.008 | 0.12 | 0.16 | 0.030 | 0.004 | 0.024 | 21.0 | 0.31 | 0.33 | 0.35 | 0.010 | INVENTION EXAMPLE |
| 19 | | | | | | | | | | | | INVENTION EXAMPLE |
| 20 | | | | | | | | | | | | INVENTION EXAMPLE |
| 21 | | | | | | | | | | | | COMPARATIVE EXAMPLE |
| 22 | 0.007 | 0.14 | 0.18 | 0.031 | 0.001 | 0.029 | 22.3 | 0.27 | 0.42 | 0.36 | 0.010 | INVENTION EXAMPLE |
| 23 | | | | | | | | | | | | INVENTION EXAMPLE |
| 24 | | | | | | | | | | | | INVENTION EXAMPLE |
| 25 | | | | | | | | | | | | COMPARATIVE EXAMPLE |
| 26 | 0.009 | 0.14 | 0.16 | 0.032 | 0.007 | 0.026 | 23.7 | 0.29 | 0.72 | 0.38 | 0.012 | INVENTION EXAMPLE |
| 27 | 0.009 | 0.15 | 0.16 | 0.032 | 0.003 | 0.027 | 21.2 | 0.30 | 0.41 | 0.52 | 0.011 | INVENTION EXAMPLE |
| 28 | 0.032 | 0.17 | 0.16 | 0.030 | 0.002 | 0.023 | 23.3 | 0.31 | 0.55 | 0.18 | 0.044 | COMPARATIVE EXAMPLE |
| 29 | 0.012 | 0.19 | 0.16 | 0.028 | 0.008 | 0.025 | 23.8 | 0.33 | 0.32 | 0.28 | 0.013 | COMPARATIVE EXAMPLE |

TABLE 4

| NO. | AVERAGE FERRITE GRAIN DIAMETER (μm) | MAXIMUM GRAIN DIAMETER OF NbC (μm) | FINISHING TEMPERATURE (° C.) | COILING TEMPERATURE (° C.) | DRAFR OF COLD ROLLING (%) | EVALUATION OF ROUGH SURFACE AT BENT PART *1 | REMARKS |
|---|---|---|---|---|---|---|---|
| 1 | 17.9 | 0.25 | 740 | 432 | 75 | x | COMPARATIVE EXAMPLE |
| 2 | 18.2 | 0.28 | 743 | 430 | 76 | ○ | INVENTION EXAMPLE |
| 3 | 18.3 | 0.33 | 736 | 430 | 75 | ○ | INVENTION EXAMPLE |
| 4 | 19.4 | 0.35 | 737 | 431 | 75 | ○ | INVENTION EXAMPLE |
| 5 | 18.7 | 0.38 | 745 | 435 | 75 | x | COMPARATIVE EXAMPLE |
| 6 | 15.4 | 0.46 | 752 | 434 | 75 | ○ | INVENTION EXAMPLE |

TABLE 4-continued

| NO. | AVERAGE FERRITE GRAIN DIAMETER (μm) | MAXIMUM GRAIN DIAMETER OF NbC (μm) | FINISHING TEMPERATURE (° C.) | COILING TEMPERATURE (° C.) | DRAFR OF COLD ROLLING (%) | EVALUATION OF ROUGH SURFACE AT BENT PART *1 | REMARKS |
|---|---|---|---|---|---|---|---|
| 7 | 18.7 | 0.48 | 751 | 435 | 76 | ○ | INVENTION EXAMPLE |
| 8 | 23.3 | 0.47 | 752 | 432 | 75 | ○ | INVENTION EXAMPLE |
| 9 | 32.2 | 0.48 | 753 | 432 | 74 | x | COMPARATIVE EXAMPLE |
| 10 | 18.4 | 0.45 | 760 | 432 | 75 | ○ | INVENTION EXAMPLE |
| 11 | 17.2 | 0.71 | 762 | 431 | 75 | ○ | INVENTION EXAMPLE |
| 12 | 18.4 | 0.88 | 765 | 433 | 74 | ○ | INVENTION EXAMPLE |
| 13 | 17.9 | 1.21 | 763 | 434 | 75 | x | COMPARATIVE EXAMPLE |
| 14 | 14.3 | 0.36 | 745 | 433 | 75 | ○ | INVENTION EXAMPLE |
| 15 | 20.2 | 0.63 | 752 | 432 | 75 | ○ | INVENTION EXAMPLE |
| 16 | 25.4 | 0.84 | 764 | 435 | 74 | ○ | INVENTION EXAMPLE |
| 17 | 31.0 | 1.08 | 782 | 436 | 75 | x | COMPARATIVE EXAMPLE |
| 18 | 18.3 | 0.44 | 758 | 407 | 75 | ○ | INVENTION EXAMPLE |
| 19 | 21.7 | 0.43 | 759 | 422 | 74 | ○ | INVENTION EXAMPLE |
| 20 | 24.5 | 0.45 | 760 | 446 | 76 | ○ | INVENTION EXAMPLE |
| 21 | 31.8 | 0.44 | 758 | 467 | 75 | x | COMPARATIVE EXAMPLE |
| 22 | 16.8 | 0.32 | 752 | 435 | 85 | ○ | INVENTION EXAMPLE |
| 23 | 19.4 | 0.38 | 753 | 435 | 74 | ○ | INVENTION EXAMPLE |
| 24 | 24.7 | 0.34 | 752 | 432 | 62 | ○ | INVENTION EXAMPLE |
| 25 | 30.2 | 0.36 | 751 | 433 | 48 | x | COMPARATIVE EXAMPLE |
| 26 | 15.3 | 0.33 | 752 | 438 | 80 | ○ | INVENTION EXAMPLE |
| 27 | 24.4 | 0.47 | 753 | 440 | 81 | ○ | INVENTION EXAMPLE |
| 28 | 34.3 | 1.55 | 753 | 433 | 88 | x | COMPARATIVE EXAMPLE |
| 29 | 32.5 | 1.43 | 852 | 512 | 81 | x | COMPARATIVE EXAMPLE |

*1: A rough-surface depth at a bent part of 30 μm or less is represented by ○, and a rough-surface depth of more than 30 μm is represented by x.

The invention claimed is:

1. A ferritic stainless steel sheet comprising:

a composition which contains 0.001 to 0.02 mass percent or less of C, 0.05 to 0.8 mass percent of Si, 0.5 mass percent or less of Mn, 0.04 mass percent or less of P, 0.010 mass percent or less of S, 0.10 mass percent or less of Al, 20 to 24 mass percent of Cr, 0.3 to 0.8 mass percent of Cu, 0.5 mass percent or less of Ni, 0.20 to 0.55 mass percent of Nb, 0.02 mass percent or less of N, and the balance being Fe and inevitable impurities; and a structure in which the maximum grain diameter of MnS inclusions is 5 μm or less.

2. The ferritic stainless steel sheet according to claim 1, further comprising at least one selected from the group consisting of 0.005 to 0.5 mass percent of Ti, 0.5 mass percent or less of Zr, and 1.0 mass percent or less of Mo is contained.

3. The ferritic stainless steel sheet according to claim 1, wherein the content of C and the content of N are each 0.001 to 0.02 mass percent, the average grain diameter of ferrite crystal grains is 30.0 μm or less, and the maximum grain diameter of precipitated NbC grains is 1 μm or less.

4. The ferritic stainless steel sheet according to claim 1, wherein the inclusions containing S are adhered to NbC grains in the steel sheet.

5. The ferritic stainless steel sheet according to claim 1, wherein the Ni content is 0.3 mass percent or less, and the Nb content is 0.20 to 0.5 mass percent.

6. The ferritic stainless steel sheet according to claim 5, further comprising at least one selected from the group consisting of 0.005 to 0.5 mass percent of Ti, 0.5 mass percent or less of Zr, and 1.0 mass percent or less of Mo is contained.

7. The ferritic stainless steel sheet according to claim 5, wherein the content of C and the content of N are each 0.001 to 0.02 mass percent, the average grain diameter of ferrite crystal grains is 30.0 μm or less, and the maximum grain diameter of precipitated NbC grains is 1 μm or less.

8. A ferritic stainless steel sheet comprising:

a composition which contains 0.02 mass percent or less of C, 0.05 to 0.8 mass percent of Si, 0.5 mass percent or less of Mn, 0.04 mass percent or less of P, 0.010 mass percent or less of S, 0.10 mass percent or less of Al, 20 to 24 mass percent of Cr, 0.3 to 0.8 mass percent of Cu, 0.5 mass percent or less of Ni, 0.20 to 0.55 mass percent of Nb, 0.02 mass percent or less of N, and the balance being Fe and inevitable impurities; and a structure in which the maximum grain diameter of inclusions containing S is 5 μm or less and the inclusions containing S are adhered to NbC grains in the steel sheet.

9. A ferritic stainless steel sheet comprising:

a composition which contains 0.001 to 0.02 mass percent of C, 0.05 to 0.8 mass percent of Si, 0.5 mass percent or less of Mn, 0.04 mass percent or less of P, 0.010 mass percent or less of S, 0.10 mass percent or less of Al, 20 to 24 mass percent of Cr, 0.3 to 0.8 mass percent of Cu, 0.5 mass percent or less of Ni, 0.20 to 0.55 mass percent of Nb, 0.02 mass percent or less of N, and the balance being Fe and inevitable impurities; and a structure in which the maximum grain diameter of inclusions containing S is 5 μm or less, the average grain diameter of ferrite crystal grains is 30.0 μm or less, and the maximum grain diameter of precipitated NbC grains is 1 μm or less.

* * * * *